US010916188B2

(12) United States Patent
Han

(10) Patent No.: US 10,916,188 B2
(45) Date of Patent: Feb. 9, 2021

(54) PIXEL COMPENSATION CIRCUIT, COMPENSATION METHOD, AND DISPLAY DEVICE

(71) Applicants: Ordos Yuansheng Optoelectronics Co., Ltd., Inner Mongolia (CN); BOE TECHNOLOGY GROUP CO., LTD., Beijing (CN)

(72) Inventor: Long Han, Beijing (CN)

(73) Assignees: Ordos Yuansheng Optoelectronics Co., Ltd., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/336,957

(22) PCT Filed: May 24, 2018

(86) PCT No.: PCT/CN2018/088213
§ 371 (c)(1),
(2) Date: Mar. 27, 2019

(87) PCT Pub. No.: WO2018/219209
PCT Pub. Date: Dec. 6, 2018

(65) Prior Publication Data

US 2019/0266942 A1 Aug. 29, 2019

(30) Foreign Application Priority Data

May 27, 2017 (CN) ..... 2017 1 0392528

(51) Int. Cl.
*G09G 3/3225* (2016.01)
*G09G 3/3208* (2016.01)

(52) U.S. Cl.
CPC ..... *G09G 3/3225* (2013.01); *G09G 3/3208* (2013.01); *G09G 2320/0204* (2013.01)

(58) Field of Classification Search
None
See application file for complete search history.

(56) References Cited

U.S. PATENT DOCUMENTS 9,076,372 B2 7/2015 Yang et al.
9,418,597 B2 8/2016 Han
(Continued)

FOREIGN PATENT DOCUMENTS

CN 101231821 A 7/2008
CN 101276544 A 10/2008
(Continued)

OTHER PUBLICATIONS

Chinese Office Action dated Aug. 29, 2018, from application No. 201710392528.1.
(Continued)

*Primary Examiner* — Duane N Taylor, Jr.
(74) *Attorney, Agent, or Firm* — Thomas|Horstemeyer, LLP

(57) ABSTRACT

The present disclosure relates to the field of display technologies, and more particularly, to a pixel circuit. The pixel circuit includes a drive transistor and an OLED light-emitting element. A first switching element transmits an initialization signal to the drive transistor in response to a reset signal. A second switching element transmits a data signal to the drive transistor in response to a scanning signal. A third switching element transmits the data signal to a coupling capacitor in response to the scanning signal. A fourth switching element is connected to the drive transistor in response to the scanning signal. A fifth switching element transmits a first power signal to the first terminal of the drive transistor in response to a control signal. A sixth switching
(Continued)

element transmits, in response to the control signal, an output current of the drive transistor to the OLED light-emitting element.

18 Claims, 4 Drawing Sheets

(56) References Cited

U.S. PATENT DOCUMENTS

| | | | | |
|---|---|---|---|---|
| 9,659,525 | B2 | 5/2017 | In et al. | |
| 10,607,538 | B2 * | 3/2020 | Zhu | G09G 3/3258 |
| 2013/0063498 | A1 * | 3/2013 | Yabukane | G09G 3/3225 345/690 |
| 2014/0078191 | A1 | 3/2014 | Yang et al. | |
| 2015/0348464 | A1 * | 12/2015 | In | G09G 3/2022 345/205 |
| 2016/0012768 | A1 | 1/2016 | In et al. | |
| 2016/0012780 | A1 | 1/2016 | Lee et al. | |
| 2016/0232849 | A1 | 8/2016 | Jeon et al. | |

FOREIGN PATENT DOCUMENTS

| | | | |
|---|---|---|---|
| CN | 101339737 | A | 1/2009 |
| CN | 101630480 | A | 1/2010 |
| CN | 102903333 | A | 1/2013 |
| CN | 103199096 | A | 7/2013 |
| CN | 103310728 | A | 9/2013 |
| CN | 103199096 | B | 12/2014 |
| CN | 104200779 | A | 12/2014 |
| CN | 104464616 | A | 3/2015 |
| CN | 102903333 | B | 5/2015 |
| CN | 104778922 | A | 7/2015 |
| CN | 104992668 | A | 10/2015 |
| CN | 105185305 | A | 12/2015 |
| CN | 105761664 | A | 7/2016 |
| CN | 105869573 | A | 8/2016 |
| CN | 106683619 | A | 5/2017 |
| CN | 106991968 | A | 7/2017 |
| CN | 104778922 | B | 12/2017 |
| TW | 201442247 | A | 11/2014 |
| TW | I518918 | B | 1/2016 |

OTHER PUBLICATIONS

International Search Report and Written Opinion dated Aug. 20, 2018, from application No. PCT/CN2018/088213.

Notification of Reexamination dated Mar. 24, 2020, from application No. 201710392528.1.

* cited by examiner

PIXEL COMPENSATION CIRCUIT, COMPENSATION METHOD, AND DISPLAY DEVICE

CROSS-REFERENCE TO RELATED APPLICATIONS

The present application is based upon International Application No. PCT/CN2018/088213, filed on May 24, 2018, which is based upon and claims priority to Chinese Patent Application No. 201710392528.1, filed on May 27, 2017, entitled as "PIXEL COMPENSATION CIRCUIT AND METHOD AND DISPLAY APPARATUS," the entire contents of which are incorporated herein by reference.

TECHNICAL FIELD

The present disclosure relates to the field of display technologies, and more particularly, to a pixel compensation circuit and method and a display apparatus.

BACKGROUND

As a current-driven light-emitting device, an organic light emitting diode (OLED) display is widely used in high-performance display fields because it is self-luminous, fast in response, wide in viewing angle, and manufacturable on a flexible substrate, etc. Based on a drive mode, the OLED may be classified into a passive matrix driving OLED (PMOLED) and an active matrix driving OLED (AMOLED). The AMOLED display is expected to become a next-generation flat panel display replacing a liquid crystal display (LCD) because it is low in manufacturing cost, high in response speed, power-saving, applicable to DC driving portable devices, and wide in operating temperature range, etc.

In related technologies, the AMOLED uses low temperature poly-silicon (LTPS) technologies to fabricate thin film transistors (TFTs), which may obtain a higher mobility K but also has a problem of drift of threshold voltage Vth. Therefore, a corresponding pixel compensation structure is needed. So far, the AMOLED pixel compensation circuit is relatively complicated in structure, and is easy to cause non-uniformity of parameters such as the threshold voltage Vth and the mobility K of the thin film transistors due to limitation of technological levels. On this basis, voltage drop of a power signal VDD due to its own wire arrangement may cause a different in power supply voltage. Therefore, it is necessary to optimize the structure of the pixel compensation circuit to compensate for the voltage difference caused by the power signal VDD so as to improve uniformity of OLED light emission brightness.

It is to be noted that the above information disclosed in this Background section is only for enhancement of understanding of the background of the present disclosure and therefore it may contain information that does not form the prior art that is already known to a person of ordinary skill in the art.

SUMMARY

Arrangements of the present disclosure relate to a pixel compensation circuit and method and a display apparatus.

According to an aspect of the present disclosure, there is provided a pixel circuit. The pixel circuit includes a drive transistor, and an OLED light-emitting element. The pixel circuit includes a first switching element. A control terminal of the first switching element is connected to a reset signal terminal, a first terminal of the first switching element is connected to an initialization signal terminal, and a second terminal of the first switching element is connected to a control terminal of the drive transistor. The pixel circuit includes a second switching element. A control terminal of the second switching element is connected to a scanning signal terminal, a first terminal of the second switching element is connected to a data signal terminal, and a second terminal of the second switching element is connected to a first terminal of the drive transistor. The pixel circuit includes a third switching element. A control terminal of the third switching element is connected to the scanning signal terminal, a first terminal of the third switching element is connected to the data signal terminal, a second terminal of the third switching element is connected to a first terminal of a coupling capacitor, and a second terminal of the coupling capacitor is connected to a first power signal terminal. The pixel circuit includes a fourth switching element, a control terminal of the fourth switching element is connected to the scanning signal terminal, and a first terminal and a second terminal of the fourth switching element respectively is connected to the control terminal and a second terminal of the drive transistor. The pixel circuit includes a fifth switching element. A control terminal of the fifth switching element is connected to a control signal terminal, a first terminal of the fifth switching element is connected to the first power signal terminal, and a second terminal of the fifth switching element is connected to the first terminal of the drive transistor. The pixel circuit includes a sixth switching element. A control terminal of the sixth switching element is connected to the control signal terminal, a first terminal of the sixth switching element is connected to the second terminal of the drive transistor, and a second terminal of the sixth switching element is connected to a first electrode of the OLED light-emitting element. The pixel circuit includes a storage capacitor connected between the data signal terminal and the control terminal of the drive transistor.

In an exemplary arrangement of the present disclosure, the pixel circuit further includes a seventh switching element. A control terminal of the seventh switching element is connected to the reset signal terminal, a first terminal of the seventh switching element is connected to the initialization signal terminal, and a second terminal of the seventh switching element is connected to the first electrode of the OLED light-emitting element.

In an exemplary arrangement of the present disclosure, a second electrode of the OLED light-emitting element is connected to a second power signal terminal.

In an exemplary arrangement of the present disclosure, all the switching elements are either P-type transistors or N-type transistors.

In an exemplary arrangement of the present disclosure, the first power signal terminal provides a high level signal, and the second power signal terminal provides a low level signal.

In an exemplary arrangement of the present disclosure, the first power signal terminal provides a low level signal, and the second power signal terminal provides a high level signal.

According to an aspect of the present disclosure, there is provided a pixel compensation method used for compensating for an OLED pixel. The pixel compensation method includes in an initialization phase, turning on a first switching element using a reset signal to transmit an initialization signal to a control terminal of a drive transistor via the first switching sub-circuit. The pixel compensation method includes in a data-writing and compensation phase, turning on a second switching element, a third switching element and a fourth switching element using a scanning signal to transmit a data signal to a first terminal of the drive transistor via the second switching element, and to transmit the data signal to a first terminal of a coupling capacitor via the third switching element. The control terminal of the drive transistor is coupled to a second terminal of the drive transistor to write a compensation voltage of the drive transistor into a storage capacitor. The pixel compensation method includes in a light emitting phase, turning on a fifth switching element and a sixth switching element using a control signal. As such, the first power signal is transmitted to the first terminal of the drive transistor via the fifth switching element. The drive transistor is turned on under the control of a voltage signal of the storage capacitor to output, under the action of the first power signal, a drive current which flows through the sixth switching element to drive the OLED light-emitting element to emit light.

In an exemplary arrangement of the present disclosure, the pixel compensation method further includes in the initialization phase, turning a seventh switching element using the reset signal to transmit the initialization signal to a first electrode of the OLED light-emitting element via the seventh switching element.

In an exemplary arrangement of the present disclosure, all the switching elements are either turned on by a low voltage level or by a high voltage level.

According to an aspect of the present disclosure, there is provided a display apparatus, which includes the above-mentioned pixel compensation circuit.

It is to be understood that the above general description and the detailed description below are merely exemplary and explanatory, and do not limit the present disclosure.

BRIEF DESCRIPTION OF THE DRAWINGS

The accompanying drawings herein are incorporated in and constitute a part of this specification, illustrate arrangements conforming to the present disclosure and together with the description serve to explain the principles of the present disclosure. Apparently, the accompanying drawings in the following description show merely some arrangements of the present disclosure, and persons of ordinary skill in the art may still derive other drawings from these accompanying drawings without creative efforts.

DETAILED DESCRIPTION

Figure 1:
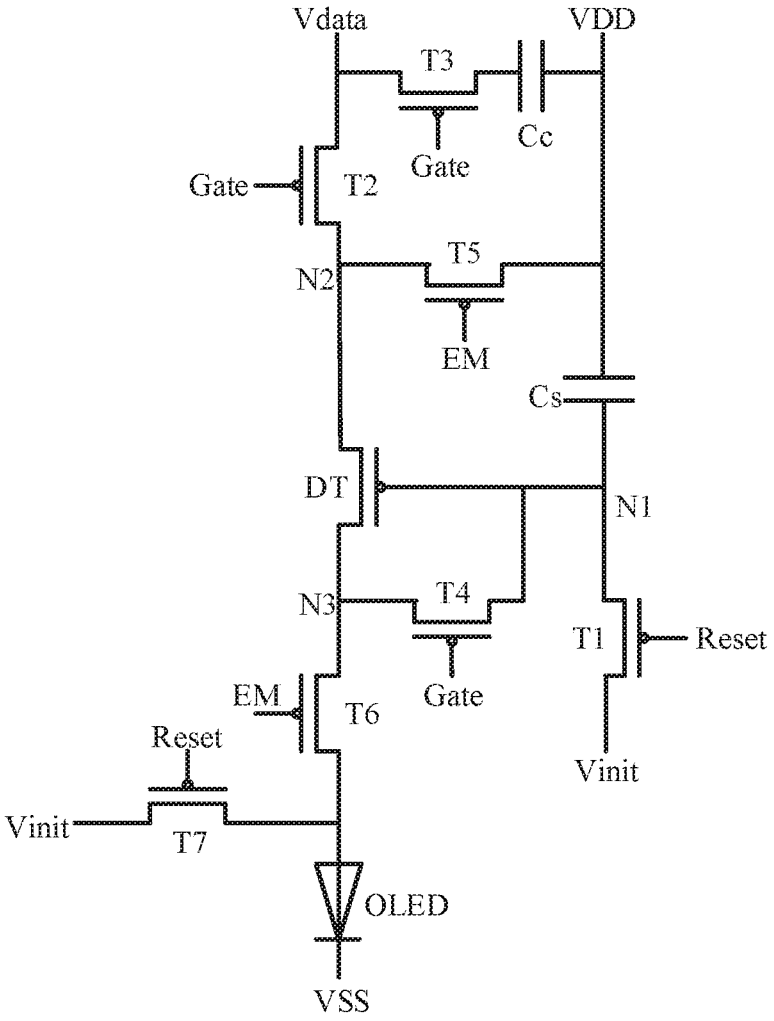
FIG. 1 schematically illustrates a schematic structural diagram of a pixel compensation circuit according to an exemplary arrangement of the present disclosure.

Exemplary arrangements will be described more comprehensively by referring to accompanying drawings now. However, the exemplary arrangements can be embodied in many forms and should not be construed as limited to the arrangements set forth herein; rather, these arrangements are provided so that this disclosure will be made thorough and complete, and the concept of exemplary arrangements will be fully conveyed to those skilled in the art. Furthermore, the described features, structures, or characteristics may be combined in any suitable manner in one or more arrangements.

In addition, the accompanying drawings are merely exemplary illustration of the present disclosure, and are not necessarily drawn to scale. The same reference numerals in the drawings denote the same or similar parts, and thus repeated description thereof will be omitted. Some block diagrams shown in the figures are functional entities and not necessarily to correspond to a physically or logically individual entities. These functional entities may be implemented in software form, or implemented in one or more hardware modules or integrated circuits, or implemented in different networks and/or processor apparatuses and/or microcontroller apparatuses.

This exemplary arrangement provides a pixel compensation circuit used for driving an OLED light-emitting element to emit light. As shown in FIG. 1, the pixel compensation circuit may include a drive transistor DT. The drive transistor DT has a control terminal, a first terminal and a second terminal and configured to drive the OLED light-emitting element to emit light. The pixel compensation circuit may include a first switching element T1. A control terminal of the first switching element T1 is connected to a reset signal terminal, a first terminal of the first switching element T1 is connected to an initialization signal terminal, and a second terminal of the first switching element T1 is connected to a control terminal of the drive transistor DT to transmit, in response to a reset signal Reset, an initialization signal Vinit to the control terminal of the drive transistor DT. The pixel compensation circuit may include a second switching element T2. A control terminal of the second switching element T2 is connected to a scanning signal terminal, a first terminal of the second switching element T2 is connected to a data signal terminal, and a second terminal of the second switching element T2 is connected to a first terminal of the drive transistor DT to transmit, in response to a scanning signal Gate, a data signal Vdata to the first terminal of the drive transistor DT. The pixel compensation circuit may include a third switching element T3. A control terminal of the third switching element T3 is connected to the scanning signal terminal, a first terminal of the third switching element T3 is connected to the data signal terminal, and a second terminal of the third switching element T3 is connected to a first terminal of a coupling capacitor Cc to transmit, in response to the scanning signal Gate, the data signal Vdata to the first terminal of the coupling capacitor Cc. A second terminal of the coupling capacitor Cc receives a first power signal VDD. The pixel compensation circuit may include a fourth switching element T4. A control terminal of the fourth switching element T4 is connected to the scanning signal terminal, and a first terminal and a second terminal of the fourth switching element T4 respectively is connected to the control terminal and the second terminal of the drive transistor DT to couple, in response to the scanning signal Gate, the control terminal of the drive transistor DT to the second terminal of the drive transistor DT. The pixel compensation circuit may include a fifth switching element T5. A control terminal of the fifth switching element T5 is connected to a control signal terminal, a first terminal of the fifth switching element T5 is connected to the first power signal terminal, and a second terminal of the fifth switching element T5 is connected to the first terminal of the drive transistor DT to transmit, in response to a control signal EM, the first power signal VDD to the first terminal of the drive transistor DT. The pixel compensation circuit may include a sixth switching element T6. A control terminal of the sixth switching element T6 is connected to the control signal terminal, a first terminal of the sixth switching element T6 is connected to the second terminal of the drive transistor DT, and a second terminal of the sixth switching element T6 is connected to a first electrode of the OLED light-emitting element to transmit, in response to the control signal EM, an output current of the drive transistor DT to the OLED light-emitting element so as to drive the OLED light-emitting element to emit light, a second electrode of the OLED light-emitting element being connected to a second power signal terminal. The pixel compensation circuit may include a storage capacitor Cs connected between the first power signal terminal and the control terminal of the drive transistor DT. The storage capacitor Cs is configured to maintain a voltage signal of the control terminal of the drive transistor DT.

The control terminal of the drive transistor DT, the second terminal of the first switching element T1 and the first terminal of the fourth switching element T4 are all connected to a first node N1. The first terminal of the drive transistor DT, the second terminal of the second switching element T2 and the second terminal of the fifth switching element T5 are all connected to a second node N2. The second terminal of the drive transistor DT, the second terminal of the fourth switching element T4 and the first terminal of the sixth switching element T6 are all connected to a third node N3.

In some arrangements, the reset signal terminal provides the reset signal Reset, the initialization signal terminal provides the initialization signal Vinit, the scanning signal terminal provides the scanning signal Gate, the data signal terminal provides the data signal Vdata, the control signal terminal provides the control signal EM, the first power signal terminal provides the first power signal VDD, and the second power signal terminal provides the second power signal VSS.

For the pixel compensation circuit provided by this exemplary arrangement of the present disclosure, the third switching element T3 and the coupling capacitor Cc are additionally arranged between the data signal terminal and the first power signal terminal. Thus, in a sampling phase, in an aspect, the pixel compensation circuit controls the second switching element T2 to be turned on to write the data signal Vdata into the first terminal of the drive transistor DT and write the data signal Vdata and a threshold voltage Vth of the drive transistor DT (i.e., Vdata+Vth) into the control terminal of the drive transistor DT so as to compensate for the threshold voltage Vth of the drive transistor DT. In another aspect, the pixel compensation circuit controls the third switching element T3 to be turned on to write the data signal Vdata into a terminal of the coupling capacitor Cc and compensate for the voltage of the first power signal VDD of different pixels based on the coupling effect of the capacitor so as to eliminate adverse effects of voltage drop of the first power signal VDD on light emission brightness and reduce load of the data signal.

As shown in FIG. 1, the pixel compensation circuit may further include a seventh switching element T7. A control terminal of the seventh switching element T7 is connected to the reset signal terminal, a first terminal of the seventh switching element T7 is connected to the initialization signal terminal, and a second terminal of the seventh switching element T7 is connected to the first electrode of the OLED light-emitting element to transmit, in response to the reset signal Reset, the initialization signal Vinit to the first electrode of the OLED light-emitting element.

In this way, the pixel compensation circuit reduces the voltage difference between two electrodes (an anode and a cathode) of the OLED light-emitting element by using the initialization voltage in the initialization phase, thus reducing the light emission brightness of the OLED light-emitting element during low grayscale display and thus increasing a pixel contrast.

In this exemplary arrangement, all the switching elements may be P-type transistors, and the driving voltage of each transistor is a low level voltage. In this case, the first power signal VDD may be a high level signal, and the second power signal VSS may be a low level signal, the first electrode of the OLED light-emitting element may be the anode, and the second electrode of the OLED light-emitting element may be the cathode.

Alternatively, all the switching elements may be N-type transistors, and the driving voltage of each transistor is a high level voltage. In this case, the first power signal VDD may be a low level signal, and the second power signal VSS may be a high level signal, the first electrode of the OLED light-emitting element may be the cathode, and the second electrode of the OLED light-emitting element may be the anode.

It is to be noted that for different types of transistors, the level signal of each signal terminal need to be correspondingly adjusted and changed. Those skilled in the art may easily obtain pixel driving circuits adopting different types of transistors according to the technical solutions of the present disclosure. Therefore, the pixel compensation circuit to be protected by the present disclosure is not limited to the implementations provided by the specific arrangements of the present disclosure, and may further include simple changes made based on the pixel compensation circuit, which are not described here.

The pixel compensation circuit of this exemplary arrangement uses a single channel type of transistors, which may simplify process manufacturing difficulties and reduce production costs. On this basis, when all the switching elements of the pixel compensation circuit are P-type transistors, the pixel compensation circuit also has following improvements: for example, strong noise suppression; for example, turning on with low voltage level which can be easily implemented in charge management. For example, N-type thin film transistors are susceptible to ground bounce, whereas the P-type thin film transistors are only affected by driving voltage drop (IR drop), and the effects of the IR drop are easily eliminated. For example, the P-type thin film transistors are simpler in manufacture procedures and lower in relative price. For example, the P-type thin film transistors are better in stability, etc. Therefore, the use of the P-type thin film transistors not only may reduce complexities of the manufacturing processes and the production costs, but also may contribute to improving the product quality.

Figure 2:
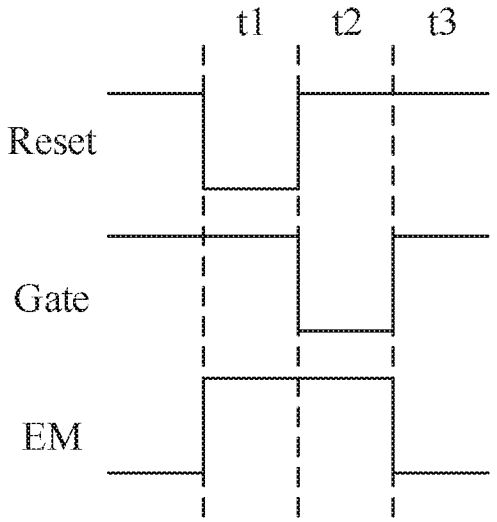
FIG. 2 schematically illustrates an operating timing diagram of a pixel compensation circuit according to an exemplary arrangement of the present disclosure.
Figure 3:
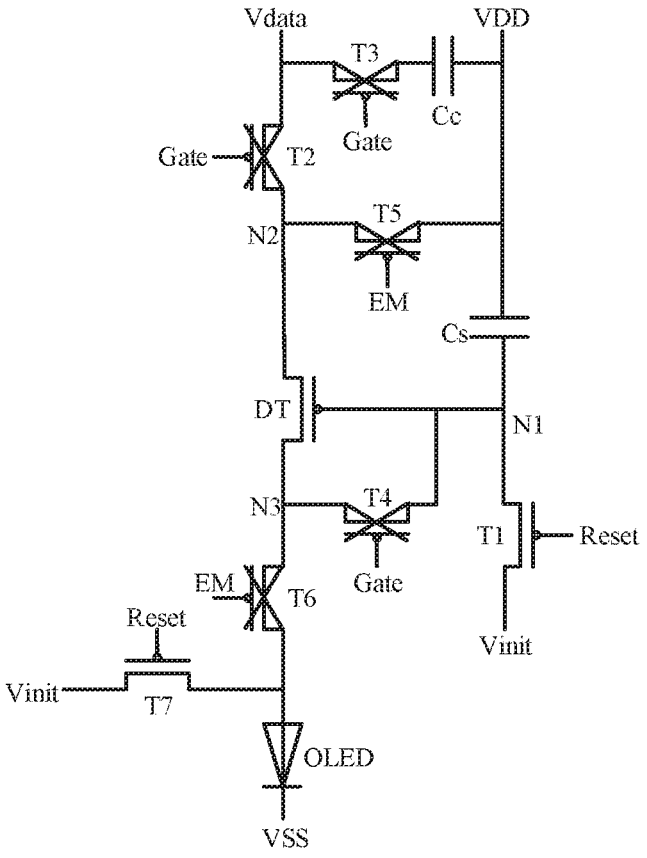
FIG. 3 schematically illustrates operation state diagram I of a pixel compensation circuit according to an exemplary arrangement of the present disclosure.
Figure 4:
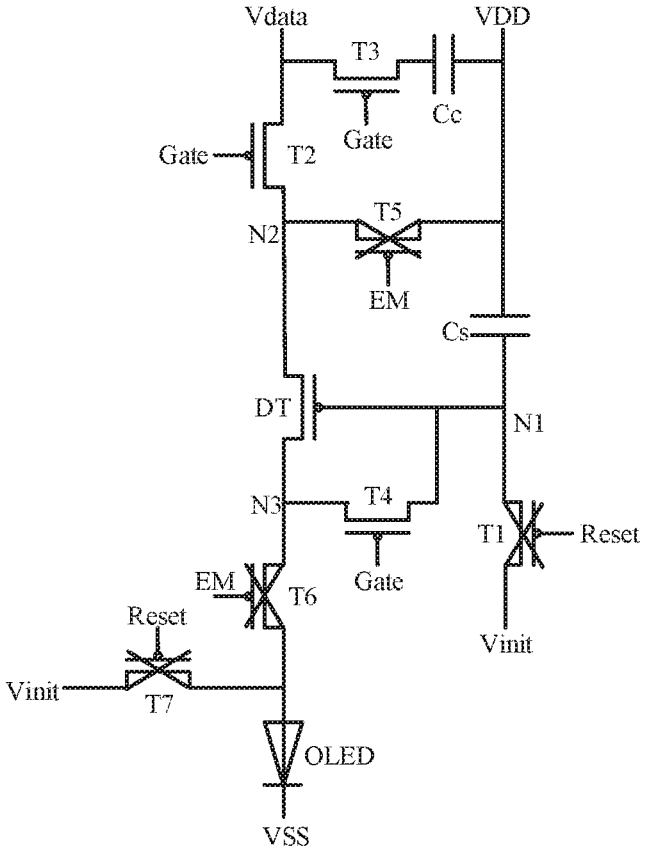
FIG. 4 schematically illustrates operation state diagram II of a pixel compensation circuit according to an exemplary arrangement of the present disclosure.
Figure 5:
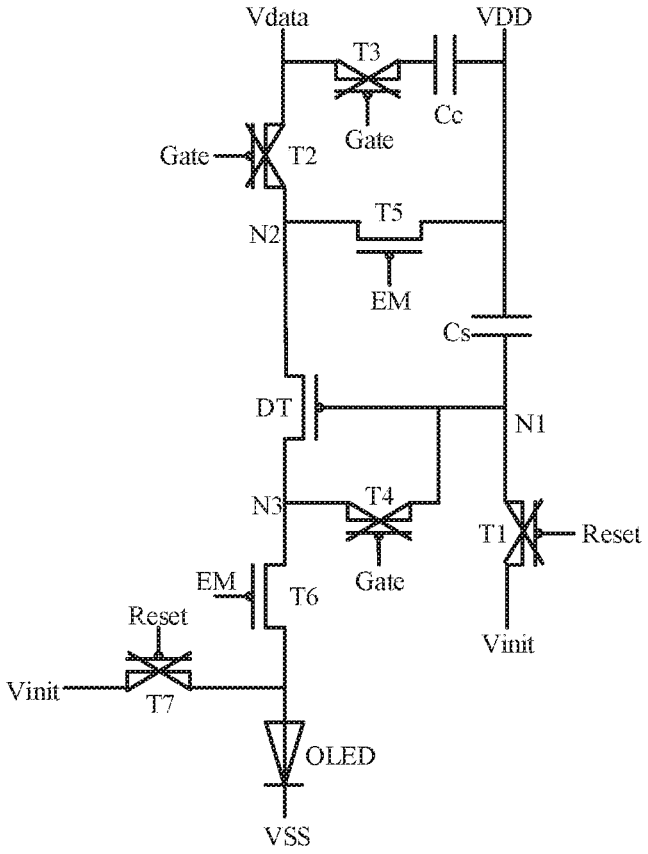
FIG. 5 schematically illustrates operation state diagram III of a pixel compensation circuit according to an exemplary arrangement of the present disclosure.

This exemplary arrangement also provides a pixel compensation method for driving an OLED light-emitting element to emit light. The pixel compensation method may include an initialization phase (a $t1^{th}$ phase), as shown in FIG. 2 and FIG. 3. In the initialization phase, a first switching element T1 and a seventh switching element T7 are turned on using a reset signal Reset to transmit an initialization signal Vinit to a control terminal (i.e., a first node N1) of a drive transistor DT via the first switching element T1 and to transmit the initialization signal Vinit to a first electrode of the OLED light-emitting element via the seventh switching element T7. The pixel compensation method may include a data-writing and compensation phase (a $t2^{th}$ phase), as shown in FIG. 2 and FIG. 4. In the data-writing and compensation phase, a second switching element T2, a third switching element T3 and a fourth switching element T4 are turned on using a scanning signal Gate to transmit a data signal Vdata to a first terminal (i.e., a second node N2) of the drive transistor DT via the second switching element T2, and to transmit the data signal Vdata to a first terminal of a coupling capacitor Cc via the third switching element T3. The control terminal of the drive transistor DT may be coupled to a second terminal of the drive transistor DT by the fourth switching element T4 to write a compensation voltage (Vdata+Vth) of the drive transistor DT into a storage capacitor Cs. The pixel compensation method may include a light emitting phase (a $t3^{th}$ phase), as shown in FIG. 2 and FIG. 5. In the light emitting phase, a fifth switching element T5 and a sixth switching element T6 are turned on using a control signal EM to transmit the first power signal VDD to the first terminal (i.e., the second node N2) of the drive transistor DT via the fifth switching element T5, such that the drive transistor DT is turned on under the control of a voltage signal of the storage capacitor Cs to output, under the action of the first power signal VDD, a drive current which flows through the sixth switching element T6 and is transmitted to the OLED light-emitting element to drive the OLED light-emitting element to emit light.

When all the switching elements are P-type transistors, turning on voltages thereof are low voltage levels. Alternatively, when all the switching elements are N-type transistors, turning on voltages thereof are high voltage levels.

On this basis, the pixel compensation method provided by this exemplary arrangement has following beneficial effects.

In the initialization phase, by applying the initialization signal Vinit to the first electrode of the OLED light-emitting element, the voltage difference between two electrodes (the anode and the cathode) of the OLED light-emitting element may be reduced, thus reducing the light emission brightness of the OLED light-emitting element during low grayscale display and thus increasing a pixel contrast.

In the data-writing and compensation phase (i.e., the sampling phase), in an aspect, the data signal Vdata is written into the first terminal of the drive transistor DT, and the data signal Vdata and a threshold voltage Vth of the drive transistor DT are written into the control terminal of the drive transistor DT and are stored into the storage capacitor Cs so as to compensate for the threshold voltage Vth of the drive transistor DT. In another aspect, the data signal Vdata is written into a terminal of the coupling capacitor Cc to compensate for the voltage of the first power signal VDD of different pixels based on the coupling effect of the capacitor so as to eliminate adverse effects of voltage drop of the first power signal VDD on light emission brightness and reduce load of the data signal Vdata.

The pixel compensation circuit and the compensation method thereof in this exemplary arrangement are described in detail below by taking an example in which all the switching elements and the drive transistor are P-type thin film transistors.

In the $t1^{th}$ phase, referring to FIG. 2 and FIG. 3, the initialization signal Vinit is a low voltage level, the reset signal Reset is a low voltage level, and both the first switching element T1 and the seventh switching element T7 are turned on. The initialization signal Vinit initializes the control terminal (i.e., the first node N1) of the drive transistor DT via the first switching element T1, the voltage of the first node N1 is an initialization voltage and the initialization voltage is stored in the storage capacitor Cs, and the drive transistor DT is turned on at this moment. The initialization signal Vinit also initializes the first electrode (i.e., the anode) of the OLED light-emitting element via the seventh switching element T7. In this way, the voltage difference between the anode and the cathode of the OLED light-emitting element may be reduced, the light emission brightness of the OLED light-emitting element may be reduced during low grayscale display, and a pixel contrast may be increased.

In the $t2^{th}$ phase, referring to FIG. 2 and FIG. 4, the scanning signal Gate is a low voltage level, and the second switching element T2, the third switching element T3 and the fourth switching element T4 are turned on. The data signal Vdata is transmitted to the first terminal (i.e., the second node N2) of the drive transistor DT via the second switching element T2. Under the action of the voltage of the storage capacitor Cs, the drive transistor DT is maintained to be turned on, and the control terminal of the drive transistor DT is couple to the second terminal of the drive transistor DT by the fourth switching element T4, such that the data signal Vdata and the threshold voltage Vth of the drive transistor DT are written into the control terminal of the drive transistor DT and are stored into the storage capacitor Cs to compensate for the threshold voltage Vth of the drive transistor DT. At this moment, the voltage of the first node N1 is Vdata+Vth. The data signal Vdata is transmitted to the first terminal of the coupling capacitor Cc via the third switching element T3 to compensate for the first power signal VDD based on the coupling effect of the coupling capacitor Cc so as to eliminate adverse effects of voltage drop of the first power signal VDD on light emission brightness and reduce load of the data signal Vdata.

In the $t3^{th}$ phase, referring to FIG. 2 and FIG. 5, the control signal EM is a low voltage level, and both the fifth switching element T5 and the sixth switching element T6 are turned on. The first power signal VDD is transmitted to the first terminal (i.e., the second node N2) of the drive transistor DT via the fifth switching element T5. At this moment, the data signal Vdata has compensated for the voltage of the first power signal VDD under the coupling action of the coupling capacitor Cc. The drive transistor DT outputs, under the action of the first power signal VDD, a drive current to a third node N3, and transmits the drive current to the OLED light-emitting element via the sixth switching element T6 to drive the OLED light-emitting element to emit light.

As can be seen from the above description, the drive current of the OLED device is as below:

$$Ion=1/2\times K\times(Vgs-Vth)^2=1/2\times K\times(Vdata-VDD)^2.$$

As can be seen, the drive current of the OLED device is merely related to the data signal Vdata and the first power signal VDD. That is, adverse effects of the threshold voltage Vth on the drive current of the OLED device are eliminated. In this way, it is avoided uneven light emission brightness caused by difference between the threshold voltages Vth of the drive transistors DT of different pixels. On this basis, the data signal Vdata also compensates for the IR drop of the first power signal VDD based on the coupling effect of the coupling capacitor Cc so as to eliminate adverse effects of voltage discrepancy of the first power signal VDD on light emission brightness uniformity and reduce load of the data signal Vdata.

It is to be noted that specific details of the OLED pixel compensation method have been described in detail in the corresponding pixel compensation circuit, and thus their detailed descriptions are omitted herein.

This exemplary arrangement further provides a display apparatus, which includes the above OLED pixel compensation circuit. Based on this, the light emission brightness uniformity of each pixel in the display apparatus is better, which can improve the display effect of an OLED product.

In this exemplary arrangement, the display apparatus may be any product or component having a display function, such as a mobile phone, a tablet computer, a TV set, a notebook computer, a digital photo frame, a navigation device and so on.

It is to be noticed that although a plurality of modules or units of the device for action execution have been mentioned in the above detailed description, this partition is not compulsory. Actually, according to the arrangement of the present disclosure, features and functions of two or more modules or units as described above may be embodied in one module or unit. Reversely, features and functions of one module or unit as described above may be further embodied in more modules or units.

In addition, operations of the method in the present disclosure are described in a particular order in the accompanying drawings. However, this does not require or imply to execute these operations necessarily according to the particular order, or this does not mean that the expected result cannot be implemented unless all the shown operations are executed. Additionally or alternatively, some operations may be omitted, a plurality of operations may be combined into one operation for execution, and/or one operation may be decomposed into a plurality of operations for execution.

Other arrangements of the present disclosure will be apparent to those skilled in the art from consideration of the specification and practice of the disclosure described herein. This application is intended to cover any variations, uses, or adaptations of the present disclosure following the general principles thereof and including such departures from the present disclosure as come within known or customary practice in the art. It is intended that the specification and arrangements be considered as exemplary only, with a true scope and spirit of the present disclosure being indicated by the appended claims.

What is claimed is:

1. A pixel circuit, comprising:

a drive transistor, configured to output a drive current;

a first switching sub-circuit, configured to transmit an initialization signal to a control terminal of the drive transistor in response to a reset signal;

a second switching sub-circuit, configured to transmit a data signal to a first terminal of the drive transistor in response to a scanning signal;

a third switching sub-circuit, configured to transmit the data signal to a first terminal of a capacitance coupling sub-circuit in response to the scanning signal, a second terminal of the capacitance coupling sub-circuit configured to receive a first power signal;

a fourth switching sub-circuit, configured to couple the control terminal of the drive transistor to a second terminal of the drive transistor in response to the scanning signal;

a fifth switching sub-circuit, configured to transmit the first power signal to the first terminal of the drive transistor in response to a control signal;

a sixth switching sub-circuit, configured to transmit, in response to the control signal, an output current of the drive transistor to an OLED light-emitting element so as to drive the OLED light-emitting element to emit light; and a storage sub-circuit, configured to maintain a voltage signal of the control terminal of the drive transistor.

2. The pixel circuit according to claim 1, wherein the first switching sub-circuit comprises a first switching element, a control terminal of the first switching element being connected to a reset signal terminal, a first terminal of the first switching element being connected to an initialization signal terminal, and a second terminal of the first switching element being connected to the control terminal of the drive transistor.

3. The pixel circuit according to claim 2, wherein the second switching sub-circuit comprises a second switching element, a control terminal of the second switching element being connected to a scanning signal terminal, a first terminal of the second switching element being connected to a data signal terminal, and a second terminal of the second switching element being connected to the first terminal of the drive transistor.

4. The pixel circuit according to claim 3, wherein the third switching sub-circuit comprises a third switching element and the capacitance coupling sub-circuit comprises a coupling capacitor, a control terminal of the third switching element being connected to the scanning signal terminal, a first terminal of the third switching element being connected to the data signal terminal, a second terminal of the third switching element being connected to a first terminal of the coupling capacitor, and a second terminal of the coupling capacitor being connected to a first power signal terminal.

5. The pixel circuit according to claim 4, wherein the fourth switching sub-circuit comprises a fourth switching element, a control terminal of the fourth switching element being connected to the scanning signal terminal, and a first terminal and a second terminal of the fourth switching element respectively being connected to the control terminal and the second terminal of the drive transistor.

6. The pixel circuit according to claim 5, wherein the fifth switching sub-circuit comprises a fifth switching element, a control terminal of the fifth switching element being connected to a control signal terminal, a first terminal of the fifth switching element being connected to the first power signal terminal, and a second terminal of the fifth switching element being connected to the first terminal of the drive transistor.

7. The pixel circuit according to claim 6, wherein the sixth switching sub-circuit comprises a sixth switching element, a control terminal of the sixth switching element being connected to the control signal terminal, a first terminal of the sixth switching element being connected to the second terminal of the drive transistor, and a second terminal of the sixth switching element being connected to a first electrode of the OLED light-emitting element.

8. The pixel circuit according to claim 7, wherein the storage sub-circuit comprises a storage capacitor connected between the first power signal terminal and the control terminal of the drive transistor.

9. The pixel circuit according to claim 8, further comprising:

a seventh switching element, a control terminal of the seventh switching element being connected to the reset signal terminal, a first terminal of the seventh switching element being connected to the initialization signal terminal, and a second terminal of the seventh switching element being connected to the first electrode of the OLED light-emitting element.

10. The pixel circuit according to claim 8, wherein a second electrode of the OLED light-emitting element is connected to a second power signal terminal.

11. The pixel circuit according to claim 8, wherein all the switching elements are transistors of a same type.

12. The pixel circuit according to claim 10, wherein the first power signal terminal provides a high level signal, and the second power signal terminal provides a low level signal.

13. The pixel circuit according to claim 10, wherein the first power signal terminal provides a low level signal, and the second power signal terminal provides a high level signal.

14. A pixel compensation method used for compensating for an OLED pixel, comprising:

in an initialization phase, turning on a first switching sub-circuit using a reset signal to transmit an initialization signal to a control terminal of a drive transistor via the first switching sub-circuit;

in a data-writing and compensation phase, turning on a second switching sub-circuit, a third switching sub-circuit and a fourth switching sub-circuit using a scanning signal to transmit a data signal to a first terminal of the drive transistor via the second switching sub-circuit, and to transmit the data signal to a first terminal of a capacitance coupling sub-circuit via the third switching sub-circuit, wherein a second terminal of the capacitance coupling sub-circuit is connected to a first power signal, the data signal compensates for a voltage of the first power signal by means of a coupling effect of the capacitance coupling sub-circuit, and the control terminal of the drive transistor is coupled to a second terminal of the drive transistor to write a compensation voltage of the drive transistor into a storage sub-circuit; and in a light emitting phase, turning on a fifth switching sub-circuit and a sixth switching sub-circuit using a control signal such that the first power signal is transmitted to the first terminal of the drive transistor via the fifth switching sub-circuit, and the drive transistor is turned on under the control of a voltage signal of the storage sub-circuit to output, under the action of the first power signal, a drive current which flows through the sixth switching sub-circuit to drive the OLED light-emitting element to emit light.

15. The pixel compensation method according to claim 14, further comprising:

in the initialization phase, turning on a seventh switching sub-circuit using the reset signal to transmit the initialization signal to a first electrode of the OLED light-emitting element via the seventh switching sub-circuit.

16. The pixel compensation method according to claim 14, wherein all the switching sub-circuits are either turned on by a low voltage level or by a high voltage level.

17. A display apparatus, comprising a pixel circuit, wherein the pixel circuit comprises:

a drive transistor, configured to output a drive current;

a first switching sub-circuit, configured to transmit an initialization signal to a control terminal of the drive transistor in response to a reset signal;

a second switching sub-circuit, configured to transmit a data signal to a first terminal of the drive transistor in response to a scanning signal;

a third switching sub-circuit, configured to transmit the data signal to a first terminal of a capacitance coupling sub-circuit in response to the scanning signal, a second terminal of the capacitance coupling sub-circuit configured to receive a first power signal;

a fourth switching sub-circuit, configured to couple the control terminal of the drive transistor to a second terminal of the drive transistor in response to the scanning signal;

a fifth switching sub-circuit, configured to transmit the first power signal to the first terminal of the drive transistor in response to a control signal;

a sixth switching sub-circuit, configured to transmit, in response to the control signal, an output current of the drive transistor to an OLED light-emitting element so as to drive the OLED light-emitting element to emit light; and a storage sub-circuit, configured to maintain a voltage signal of the control terminal of the drive transistor.

18. The display apparatus according to claim 17, wherein the first switching sub-circuit comprises a first switching element, a control terminal of the first switching element being connected to a reset signal terminal, a first terminal of the first switching element being connected to an initialization signal terminal, and a second terminal of the first switching element being connected to the control terminal of the drive transistor.

* * * * *